United States Patent [19]

Orbons

[11] Patent Number: 4,693,585

[45] Date of Patent: Sep. 15, 1987

[54] CONTACT FIXING DEVICE WITH AN IMPROVED CLEANING ROLLER

[75] Inventor: Wilhelmus H. M. Orbons, Grubbenvorst, Netherlands

[73] Assignee: Oce-Nederland B.V., Venlo, Netherlands

[21] Appl. No.: 872,217

[22] Filed: Jun. 9, 1986

[30] Foreign Application Priority Data

Jun. 14, 1985 [NL] Netherlands ..... 8501717

[51] Int. Cl.[4] ..... G03G 15/00

[52] U.S. Cl. ..... 355/3 FU; 355/3 R; 355/14 FU; 355/15

[58] Field of Search ..... 355/3 FU, 14 FU, 15, 355/3 R, 3 BE; 219/216

[56] References Cited

U.S. PATENT DOCUMENTS 4,042,804 8/1977 Moser ..... 219/216
4,200,389 4/1980 Matsui et al. ..... 355/3 FU
4,269,594 5/1981 Umans et al. ..... 355/3 FU X
4,356,764 11/1982 Haugen ..... 100/169
4,540,267 9/1985 Moser ..... 355/14 FU X
4,549,803 10/1985 Ohno et al. ..... 355/14 FU

*Primary Examiner*—A. C. Prescott
*Attorney, Agent, or Firm*—Reed Smith Shaw & McClay

[57] ABSTRACT

A contact fixing device primarily used in electrophotographic copiers is described. It has a driven and heated fixing surface which is made from a partially resilient material and a driven pressure surface which presses against the fixing surface forming a fixing zone through which copy material can be fed for fixing a toner image thereon. It also has a hollow perforated cleaning roller which while rotating in contact with the fixing surface takes up toner from the fixing surface. To prevent contamination of the device due to toner material flowing over the ends of the cleaning roller, this roller is provided with a narrow circular thickening near each end.

3 Claims, 3 Drawing Figures

CONTACT FIXING DEVICE WITH AN IMPROVED CLEANING ROLLER

BACKGROUND OF THE INVENTION

1. Field of the Invention

The present invention relates to a contact fixing device used primarily in electrophotographic copiers for fixing a toner image on a sheet material.

2. Description of the Prior Art

European Patent Application No. 0149860 describes a contact fixing device for fixing a toner image on a sheet material. In this device, toner and other material which adheres to the fixing surface is taken up by the cleaning roller. Thus, a toner layer gradually forms on the surface of the cleaning roller and is subject to pressure as it passes through the nip between the cleaning roller and the fixing surface. As a result of the pressure in the nip, toner is forced through the perforations and into the interior of the cleaning roller.

The toner taken up by the cleaning roller is distributed uniformly over the roller surface by the pressure in the nip. The pressure distributes the toner material in all directions on the cleaning roller. Toner situated on the roller near its ends will move laterally over the roller surface under this pressure and will flow over those ends and contaminate the device as it becomes detached from the roller. It would be desirable to have a device which obviates this contamination.

U.S. Pat. No. 4,411,042 describes a toner cleaning apparatus used in a contact fixing device which could have the shape of a perforated roller. Residual toner particles on the fixing surface are scraped off by the edge portions of the perforations and fall into a receptacle in the interior of the cleaning apparatus. With this cleaning apparatus, there is nothing to prevent the toner material from moving laterally over the cleaning surface and eventually flowing over the ends of the cleaning device causing contamination as described above.

U.S. Pat. No. 3,649,992 discloses another cleaning apparatus used in a contact fixing device which does not employ a perforated cleaning roller. Instead, it uses a plurality of washer-shaped rollers upon which the toner particles cool and solidify forming a layer. When the layer of toner particles builds up on the rollers, the rollers are replaced. The end caps only hold the washer-shaped rollers in place and do not press against the fixing surface. If toner builds up quickly in this device, the rollers will need to be replaced very often causing inefficiency.

A still different cleaning system used in a contact fixing device is described in U.S. Pat. No. 4,165,173. This system utilizes a first scraper blade for removing residual toner particles from the surface of a photosensitive drum, a resilient unperforated transfer roller which picks up the removed toner particles but does not press against the photosensitive drum and a second scraper blade which removes toner particles from the transfer roller surface. One disadvantage with this system is that the scraper blades can damage the transfer roller. Additionally, not all of the residual toner is removed because the transfer roller does not press against the photosensitive drum.

SUMMARY OF THE INVENTION

Generally, the present invention relates to a contact fixing device comprising a fixing surface made from a somewhat resilient material, a means for driving the fixing surface, a means for heating the fixing surface, a pressure surface which presses against the fixing surface forming a fixing zone through which copy material can be fed for fixing a toner image thereon, a means for driving the pressure surface and a hollow perforated cleaning roller which while rotating in contact with the fixing surface takes up toner from the fixing surface and has a narrow circular thickening near each end.

As a result of the narrow circular thickening near each end, narrow zones form in the nip near the ends of the cleaning roller which have a higher pressure than the rest of the nip. These zones form barriers to toner particles which might move laterally over the surface of the cleaning roller preventing the toner particles from reaching and flowing over the ends of the roller. Contamination of the device is thus obviated.

Other features and advantages of the present invention will be apparent from the following detailed description and with reference to the accompanying drawings.

DESCRIPTION OF THE PREFERRED EMBODIMENTS

Figure 1:
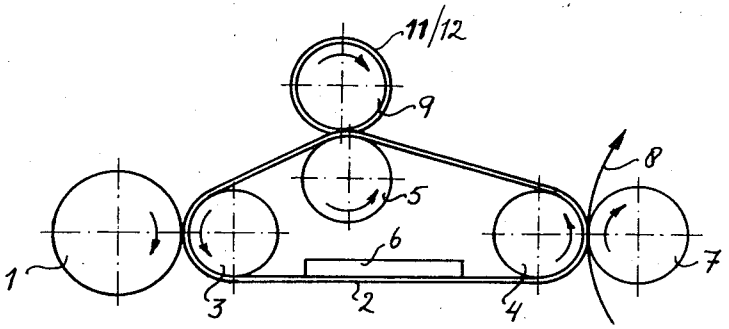
FIG. 1 is a diagrammatic cross-section of a contact fixing device according to the present invention.

FIG. 1 shows an image-bearing element 1 such as a rotating photo-conductive cylinder on which an image consisting of thermoplastic image powder or toner is formed by well known electrophotographic means which are not shown. A fixing belt 2 is trained about rollers 3, 4 and 5 and is driven such that image-bearing element 1 and belt 2 have identical superficial speeds. Rollers 3, 4 and/or 5 are driven by a drive means (not shown) such as a motor and connecting mechanism which are known to those skilled in the art of electrophotographic copiers.

Belt 2 is made from or covered with a heat-resistant and resilient material such as silicone rubber. During its advance, belt 2 is heated by a heating means 6 such as a flat heater element over which the belt slides. Belt 2 is pressed against image-bearing element 1 by means of roller 3. Belt 2 is also pressed against roller 7 by means of roller 4. Roller 7 rotates at the same superficial speed as belt 2.

A toner image formed on image-bearing element 1 is transferred onto belt 2 due to the pressure in the nip between image-bearing element 1 and belt 2 trained about roller 3. Since belt 2 is heated, the transferred toner image is also heated and becomes tacky. The transferred toner image is carried by belt 2 to roller 7.

When a sheet of paper 8 is passed between belt 2 and roller 7 at the correct time, the tacky toner image will be pressed between the fibers of sheet 8 due to the pressure in the nip between belt 2 and roller 7 and will adhere thereto. When sheet 8 is then separated from belt 2 and the toner material has cooled, the image is fixed on sheet 8.

Toner particles which have not been transferred onto sheet 8 after passing the nip between belt 2 and roller 7 are carried by belt 2 to the nip between belt 2 and a cleaning roller 9. Cleaning roller 9 is hollow and is made from a material such as steel or aluminum for which the tacky toner material has a great affinity. Cleaning roller 9 is also provided with a large number of small perforations 10 (shown in FIGS. 2 and 3) of a diameter of about 1–3 mm, which are distributed over the entire surface of cleaning roller 9 in a pattern such that, when belt 2 rotates, each part of the surface of belt 2 comes into contact with a part of the surface of roller 9 containing the perforations.

Good cooperation between belt 2 and cleaning roller 9 can be obtained if cleaning roller 9 presses on belt 2 by its own weight and is rotatingly driven by the friction between it and belt 2. Consequently, toner particles present on belt 2, together with any impurities retained thereon, such as dust and paper fibers, adhere to cleaning roller 9 and form a layer thereon. Pressure is exerted on this layer as it passes the nip between belt 2 and cleaning roller 9 causing the toner material to be pressed through the perforations and to be discharged into the interior of cleaning roller 9.

Figure 2:
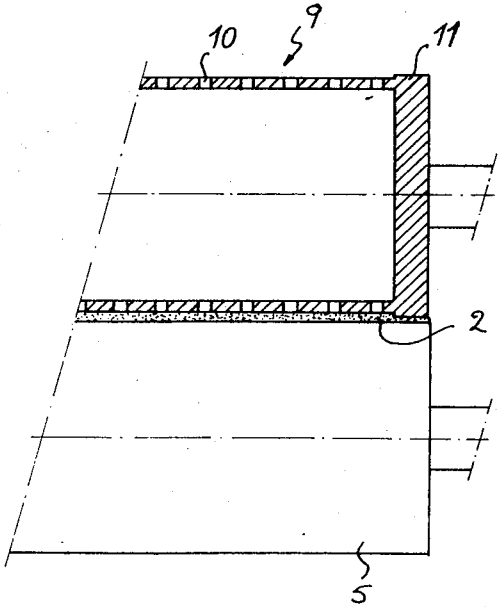
FIGS. 2 and 3 are diagrammatic longitudinal sections of part of the cleaning roller used in the contact fixing device shown in FIG. 1.

The toner material in the layer on cleaning roller 9 is distributed uniformly over the surface by the pressure in the nip. Thus, the toner material moves over the surface in every direction. To prevent toner particles or material from reaching the ends, cleaning roller 9 is provided with a narrow circular thickening 11 at both ends as shown in FIG. 2. Thickenings 11 prevent the moving toner material from passing the ends of cleaning roller 9 and becoming detached, thereby, contaminating the device.

The provision of thickening 11 at each end of cleaning roller 9 causes a higher pressure to be exerted at their locations on belt 2 in the nip between belt 2 and cleaning roller 9 than in the rest of the nip. Toner material in the nip forced in the direction of the cleaning roller ends cannot enter the higher pressure zones and, therefore, cannot reach the cleaning roller ends, thus, preventing contamination.

It has been found that to achieve the desired effect, thickening 11 needs to project only slightly from the surface of cleaning roller 9 and that its dimensions are not critical. Thus, with the embodiment of cleaning roller 9 illustrated diagrammatically in FIG. 2 in which thickening 11 is integral with the sleeve of cleaning roller 9, excellent results are obtained if the sleeve has a diameter of about 60 mm and thickening 11 has a width of 2–5 mm and projects 0.3–0.5 mm from the surface of the sleeve.

Figure 3:
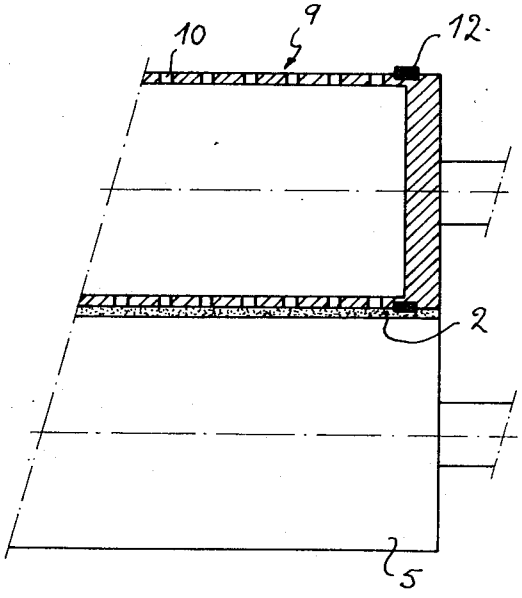

In another attractive embodiment, as shown in FIG. 3, the thickening is obtained by providing cleaning roller 9 near each end with a circular groove and placing in each groove an endless belt 12 made from a somewhat resilient material and having a thickness so as to project 0.3 mm from the surface of the sleeve of cleaning roller 9. If belt 12 is made from a material to which toner adheres poorly, such as silicone rubber, this prevents toner which has accidentally arrived at belt 12 from being able to adhere permanently thereto which might cause malfunctioning.

While presently preferred embodiments of the invention have been described and shown in the drawings with particularity, the invention may be otherwise embodied within the scope of the appended claims.

What is claimed is:

1. A contact fixing device comprising a fixing surface made from a somewhat resilient material, a means for driving the fixing surface, a means for heating the fixing surface, a pressure surface which presses against the fixing surface forming a fixing zone through which copy material can be fed for fixing a toner image thereon, a means for driving the pressure surface and a hollow perforated cleaning roller which while rotating in contact with the fixing surface takes up toner from the fixing surface and has a narrow circular thickening near each end.

2. A device as described in claim 1 wherein the narrow circular thickening near each end is formed by an endless belt of a somewhat resilient material which lies in and projects from a groove formed in the cleaning roller.

3. A device as described in claim 2 wherein the endless belt is also made from a material to which toner adheres poorly.

* * * * *